US005866291A

United States Patent [19]

Ikegami et al.

[11] Patent Number: 5,866,291

[45] Date of Patent: Feb. 2, 1999

[54] DEVELOPING AGENT AND IMAGE FORMING APPARATUS

[75] Inventors: Masako Ikegami, Yokohama; Takahiro Mochizuki, Kawasaki, both of Japan

[73] Assignee: Kabushiki Kaisha Toshiba, Kawasaki, Japan

[21] Appl. No.: 928,475

[22] Filed: Sep. 12, 1997

[30] Foreign Application Priority Data

Sep. 18, 1996 [JP] Japan ..... 8-246698

[51] Int. Cl.[6] ..... G03G 9/097; G03G 15/08

[52] U.S. Cl. ..... 430/110; 430/111; 399/252

[58] Field of Search ..... 430/110, 111

[56] References Cited

U.S. PATENT DOCUMENTS

| | | | |
|---|---|---|---|
| 5,173,387 | 12/1992 | Niki et al. | 430/110 |
| 5,225,303 | 7/1993 | Tomita et al. | 430/110 |
| 5,389,483 | 2/1995 | Kawasaki et al. | 430/110 |
| 5,518,851 | 5/1996 | Katagiri et al. | 430/110 |
| 5,660,964 | 8/1997 | Machida et al. | 430/111 |
| 5,712,071 | 1/1998 | Mikuriya et al. | 430/111 |

FOREIGN PATENT DOCUMENTS

| | | |
|---|---|---|
| 4-30580 | 2/1992 | Japan . |
| 5-88405 | 4/1993 | Japan . |

*Primary Examiner*—Roland Martin
*Attorney, Agent, or Firm*—Foley & Lardner

[57] ABSTRACT

A developing agent contains a first wax-containing binder resin having a first wax and a first binder resin, a second wax-containing binder resin having a second wax and a second binder resin, and a coloring material. If the dispersibility of a wax is low because its SP value, molecular weight, or glass transition point is high, combinations of these waxes and resins are so selected that a resin having an SP value close to the SP value of that wax or a resin having a high SP value is combined with that wax.

24 Claims, 1 Drawing Sheet

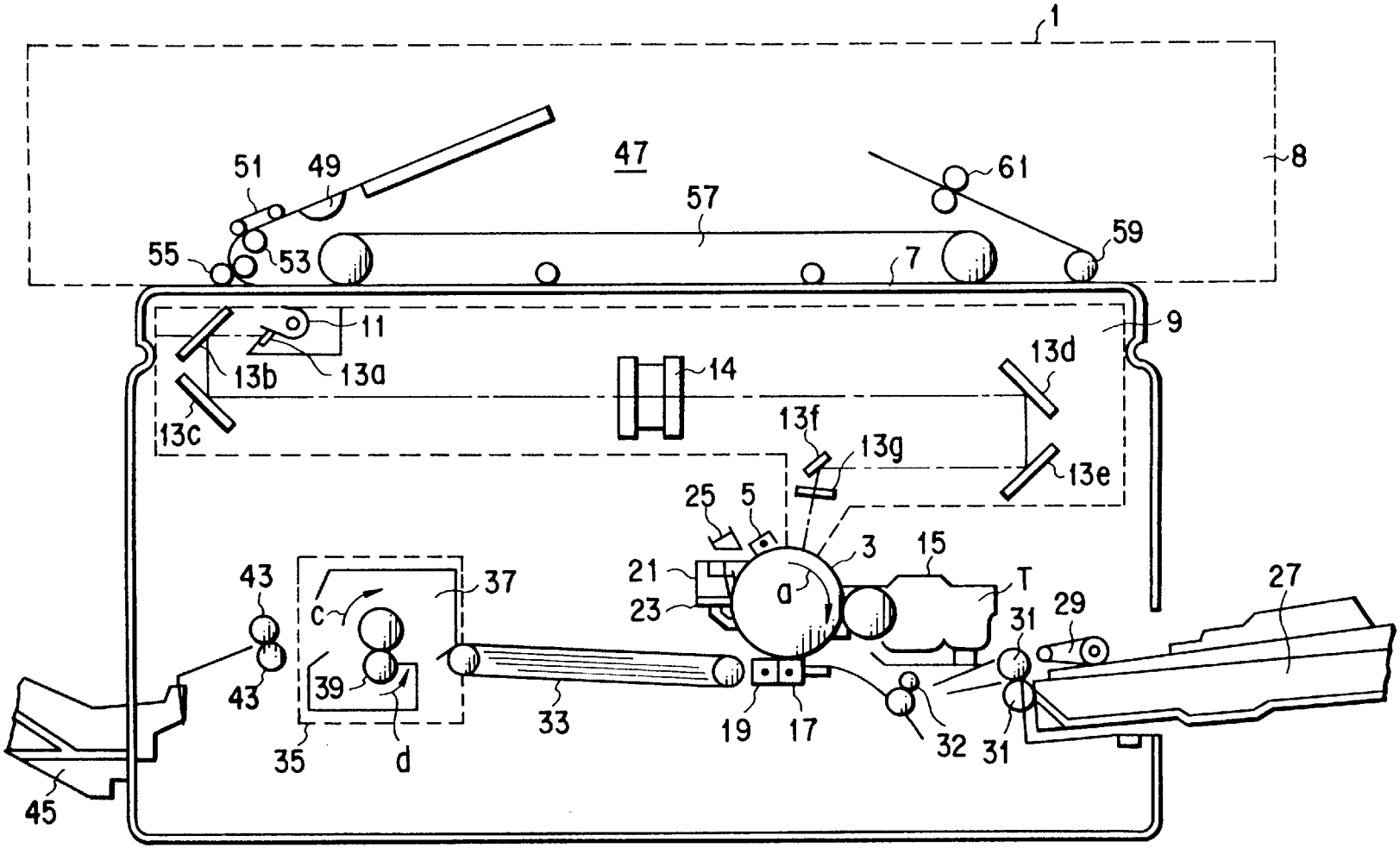
1
8
9
59
61
7
57
47
49
51
53
55
11
13a
13b
13c
13d
13e
13f
13g
14
27
29
31
31
32
T
15
3
d
5
25
21
23
17
19
33
37
35
39
c
d
43
43
45

DEVELOPING AGENT AND IMAGE FORMING APPARATUS

BACKGROUND OF THE INVENTION

The present invention relates to an image forming apparatus used in an image forming method using a technique of electrophotography or electrostatic recording and a developing agent used to visualize an electrostatic charge latent image in this image forming apparatus.

In a method of electrophotography, a photoconductive substance is generally used to form an electrical latent image on a photosensitive member by various methods. The latent image is then developed with toner and, the toner image is transferred onto a transfer medium such as paper. Thereafter, the toner image is fixed on the transfer medium by various methods to obtain a copy.

Generally, toner is classified into dry and wet toners. Since wet toner has problems relating to evaporation, recovery, and smell of solvents, dry toner s prevalent in recent years.

Dry toner is a powder, and it is necessary to impart a number of functions to the toner particles in order to accurately form toner images. A dry electrophotographic developing agent is required to simultaneously have various characteristics, i.e., (1) to prevent offset during fixing and (2) to prevent smear by which, when a toner-fixed sheet is conveyed as n original in an ADF, the fixed toner peels off from the sheet, and the like.

To meet these demands, Jpn. Pat. Appln. KOKAI Publication No. 4-358159 has disclosed a method by which two kinds of waxes having different softening temperatures are contained in toner.

When two types of waxes are used, however, it is difficult to disperse these waxes uniformly in a single resin. Low dispersibility of waxes results in problems that masses of waxes stick to a photosensitive member to produce black dots in an image, electrostatic charging fails to scatter toner, and the backside of a copy sheet is contaminated by detached developing agent.

BRIEF SUMMARY OF THE INVENTION

The present invention has been made in consideration of the above situation and has as its object to provide a developing agent which has high dispersibility to a binder resin and waxes and a high offset resistance and prevents smear, black dots, and backside contamination.

It is another object of the present invention to provide an image forming apparatus capable of obtaining high-quality images by using this developing agent.

According to the first aspect of the present invention, there is provided a developing agent containing a first wax-containing binder resin having a first wax and a first binder resin, a second wax-containing binder resin having a second wax nd a second binder resin, and a coloring material, wherein the first wax has a first solubility parameter value SP1, the first binder resin has a second solubility parameter value SP2 having a difference Δ1 from the first solubility parameter value SP1, the second wax has a third solubility parameter value SP3 smaller than the first solubility parameter value SP1, and the second binder resin has a solubility parameter value SP4 having a difference Δ2 larger than Δ1 from the first solubility parameter value SP1.

According to the second aspect of the present invention, there is provided a developing agent containing a first wax-containing binder resin having a first wax and a first binder resin, a second wax-containing binder resin having a second wax and a second binder resin, and a coloring material, wherein the first wax has a first solubility parameter value SP1, the first binder resin has a first molecular weight M1, the second wax has a third solubility parameter value SP3 smaller than the first solubility parameter value SP1, and the second binder resin has a second molecular weight M2 smaller than the first molecular weight M1.

According to the third aspect of the present invention, there is provided a developing agent containing a first wax-containing binder resin having a first wax and a first binder resin, a second wax-containing binder resin having a second wax and a second binder resin, and a coloring material, wherein the first wax has a first solubility parameter value SP1, the first binder resin has a first glass transition point Tg1, the second wax has a third solubility parameter value SP3 smaller than the first solubility parameter value SP1, and the second binder resin has a second glass transition point Tg2 smaller than the first glass transition point Tg1.

According to the fourth aspect of the present invention, there is provided an image forming apparatus comprising an image carrier, an electrostatic latent image forming member for forming an electrostatic latent image on the image carrier in accordance with image information, a developing unit which contains a eveloping agent and forms a developing agent image by developing the electrostatic latent image by using the developing agent, and a transfer member for transferring the developing agent image to a transfer medium, wherein the developing agent contains a first wax-containing binder resin having a first wax and a first binder resin, a second wax-containing binder resin having a second wax and a second binder resin, and a coloring material, the first wax has a first solubility parameter value SP1, the first binder resin has a second solubility parameter value SP2 having a difference Δ1 from the first solubility parameter value SP1, the second wax has a third solubility parameter value SP3 smaller than the first solubility parameter value SP1, and the second binder resin has a solubility parameter value SP4 having a difference Δ2 larger than Δ1 from the first solubility parameter value SP1.

According to the fifth aspect of the present invention, there is provided an image forming apparatus comprising an image carrier, an electrostatic latent image forming member for forming an electrostatic latent image on the image carrier in accordance with image information, a developing unit which contains a developing agent and forms a developing agent image by developing the electrostatic latent image by using the developing agent, and a transfer member for transferring the developing agent image to a transfer medium, wherein the developing agent contains a first wax-containing binder resin having a first wax and a first binder resin, a second wax-containing binder resin having a second wax and a second binder resin, and a coloring material, wherein the first wax has a first solubility parameter value SP1, the first binder resin has a second solubility parameter value SP2 having a difference Δ1 from the first solubility parameter value SP1, a first molecular weight M1, and a first glass transition point Tg1, the second wax has a third solubility parameter value SP3 smaller than the first solubility parameter value SP1, and the second binder resin has a fourth solubility parameter value SP4 having a difference Δ2 larger than Δ1 from the first solubility parameter value SP1, a second molecular weight M2 smaller than the first molecular weight M1, and a second glass transition point Tg2 smaller than the first glass transition point Tg1.

According to the sixth aspect of the present invention, there is provided an image forming apparatus comprising an image carrier, an electrostatic latent image forming member for forming an electrostatic latent image on the image carrier in accordance with image information, a developing unit which contains a developing agent and forms a developing agent image by developing the electrostatic latent image by using the developing agent, and a transfer member for transferring the developing agent image to a transfer medium, wherein the developing agent contains a first wax-containing binder resin having a first wax and a first binder resin, a second wax-containing binder resin having a second wax and a second binder resin, and a coloring material, the first wax has a first solubility parameter value SP1, the first binder resin has a first molecular weight M1, the second wax has a third solubility parameter value SP3 smaller than the first solubility parameter value SP1, and the second binder resin has a second molecular weight M2 smaller than the first molecular weight M1.

According to the seventh aspect of the present invention, there is provided an image forming apparatus comprising an image carrier, an electrostatic latent image forming member for forming an electrostatic latent image on the image carrier in accordance with image information, a developing unit which contains a developing agent and forms a developing agent image by developing the electrostatic latent image by using the developing agent, and a transfer member for transferring the developing agent image to a transfer medium, wherein the developing agent contains a first wax-containing binder resin having a first wax and a first binder resin, a second wax-containing binder resin having a second wax and a second binder resin, and a coloring material, the first wax has a first solubility parameter value SP1, the first binder resin has a first glass transition point Tg1, the second wax has a third solubility parameter value SP3 smaller than the first solubility parameter value SP1, and the second binder resin has a second glass transition point Tg2 smaller than the first glass transition point Tg1.

In the developing agent of the present invention, if the dispersibility of a wax is low because its SP value, molecular weight, or glass transition point is high, combinations of waxes and resins are so selected that a resin having an SP value close to the SP value of that wax or a resin having a high SP value is combined with that wax. This improves the dispersibility between the binder resin and the wax.

Also, the image forming apparatus of the present invention uses a developing agent in which the dispersibility between a binder resin and a wax is improved as described above. Accordingly, it is possible to effectively prevent offset, smear, black dots, and backside contamination.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGURE is a schematic view showing an embodiment of an image forming apparatus of the present invention.

DETAILED DESCRIPTION OF THE INVENTION

The prevent inventors have made extensive studies to well disperse two kinds of waxes in a binder resin or resins used in a developing agent and found that the dispersibility of a wax is affected by the solubility parameter values (to be referred to as SP values hereinafter) of the wax and a binder resin.

A wax has the properties that the higher the solubility parameter value of the wax the more hardly the wax disperses in a binder resin, and the lower the solubility parameter value of the wax the more easily the wax disperses in a binder resin.

Also, a binder resin and a wax disperse more easily as their solubility parameter values are closer.

A developing agent of the present invention basically contains a coloring material and a binder resin composition, and this binder resin composition contains a mixture of a first wax-containing binder resin having a first wax and a first binder resin and a second wax-containing binder resin having a second wax and a second binder resin.

In a wax-containing binder resin, a wax can be added when a binder resin is polymerized or can be melt-kneaded together with a binder resin. It is preferable to add a wax when a binder resin is polymerized because the dispersibility is further improved.

The developing agent of the present invention is roughly classified into the following three aspects in accordance with the characteristics of the two types of waxes and the two types of binder resins used in the binder resin composition.

In a binder resin composition according to the first aspect of the present invention, the first wax has a first solubility parameter value SP1, the first binder resin has a second solubility parameter value SP2 having a difference Δ1 from the first solubility parameter value SP1, the second wax has a third solubility parameter value SP3 smaller than the first solubility parameter value SP1, and the second binder resin has a solubility parameter value SP4 having a difference Δ2 larger than Δ1 from the first solubility parameter value SP1.

In this binder resin composition, the first wax-containing binder resin is obtained by combining the wax having a higher SP value with the binder resin having an SP value close to the SP value of that wax, and the second wax-containing binder resin is obtained by combining the other wax with the other binder resin.

Note that the solubility parameter value means a value indicating a means of mixing properties, is represented as δ $(cal/cm^3)^{1/2}$. If cohesive energy of molecule is shown as E cal/mol and molecular volume is shown as V $cm^3$/mol, δ is represented as $(E/V)^{1/2}$. It is considered that solubility parameter values of two types of polymers are closer each other, degree of mixing or binding between the two types of polymers would be better.

In the first preferred embodiment of the binder resin composition according to the first aspect of the present invention, the first wax has a first solubility parameter value SP1, the first binder resin has a second solubility parameter value SP2 having a difference Δ1 from the first solubility parameter value SP1 and a first molecular weight M1, the second wax has a third solubility parameter value SP3 smaller than the first solubility parameter value SP1, and the second binder resin has a fourth solubility parameter value SP4 having a difference Δ2 larger than Δ1 from the first solubility parameter value SP1 and a second molecular weight M2 smaller than the first molecular weight M1.

In this first preferred embodiment, the first wax-containing binder resin is obtained by combining one of the two types of binder resins having a higher molecular weight with the wax having an SP value close to or identical with the SP value of this binder resin, and the second wax-containing binder resin is obtained by combining the other wax with the other binder resin. If the two types of binder resins have the same SP value, it is only necessary to disperse the wax having a higher SP value in the resin having a higher molecular weight.

In the second preferred embodiment of the developing agent according to the first aspect of the present invention, the first wax has a first solubility parameter value SP1, the first binder resin has a second solubility parameter value SP2 having a difference Δ1 from the first solubility parameter value SP1 and a first glass transition point Tg1, the second wax has a third solubility parameter value SP3 smaller than the first solubility parameter value SP1, and the second binder resin has a fourth solubility parameter value SP4 having a difference Δ2 larger than Δ1 from the first solubility parameter value SP1 and a second glass transition point Tg2 smaller than the first glass transition point Tg1.

In this second preferred embodiment, the first wax-containing binder resin is obtained by combining one of the two types of binder resins having a higher glass transition point with the wax having an SP value close to or identical with the SP value of this binder resin, and the second wax-containing binder resin is obtained by combining the other wax with the other binder resin. If the two types of binder resins have the same SP value, it is only necessary to disperse the wax having a higher SP value in the resin having a higher glass transition point.

In the third preferred embodiment of the binder resin composition according to the first aspect of the present invention, the first wax has a first solubility parameter value SP1, the first binder resin has a second solubility parameter value SP2 having a difference Δ1 from the first solubility parameter value SP1, a first molecular weight M1, and a first glass transition point Tg1, the second wax has a third solubility parameter value SP3 smaller than the first solubility parameter value SP1, and the second binder resin has a fourth solubility parameter value SP4 having a difference Δ2 larger than Δ1 from the first solubility parameter value SP1, a second molecular weight M2 smaller than the first molecular weight M1, and a second glass transition point Tg2 smaller than the first glass transition point Tg1.

This third preferred embodiment makes use of a binder resin mixture having the characteristics of both the binder resin mixtures used in the developing agents according to the first and third aspects described previously. That is, the first wax-containing binder resin is obtained by combining one of the two types of binder resins having a higher molecular weight and a higher glass transition point with one of the two types of waxes having an SP value close to or identical with the SP value of that binder resin, and the second wax-containing binder resin is obtained by combining the other wax with the other binder resin.

According to the second aspect of the present invention, there is provided a developing agent in which the first wax has a first solubility parameter value SP1, the first binder resin has a first molecular weight M1, the second wax has a third solubility parameter value SP3 smaller than the first solubility parameter value SP1, and the second binder resin has a second molecular weight M2 smaller than the first molecular weight M1.

In the developing agent according to the second aspect, the first wax-containing binder resin is obtained by combining the wax having a higher SP value with the binder resin having a higher molecular weight, and the second wax-containing binder resin is obtained by combining the other wax with the other binder resin.

According to the third aspect of the present invention, there is provided a developing agent in which the first wax has a first solubility parameter value SP1, the first binder resin has a first glass transition point Tg1, the second wax has a third solubility parameter value SP3 smaller than the first solubility parameter value SP1, and the second binder resin has a second glass transition point Tg2 smaller than the first glass transition point Tg1.

In the developing agent according to the third aspect, the first wax-containing binder resin is obtained by combining the wax having a higher SP value with the binder resin having a higher glass transition point, and the second wax-containing binder resin is obtained by combining the other wax with the other binder resin.

In the developing agents as described above, two types of waxes are well dispersed. These two types of waxes can be properly selected in accordance with the desired characteristics of a developing agent, e.g., the charging characteristic, the conveyance characteristic, the fixing characteristic, the coloring characteristic, and the storage stability. Also, when applied to an image forming apparatus as described below, these developing agents exhibit a high offset resistance and prevent smear and the like.

An image forming apparatus of the present invention basically comprises an image carrier, an electrostatic latent image forming member for forming an electrostatic latent image on the image carrier in accordance with image information, a developing unit which contains a developing agent and forms a developing agent image by developing the electrostatic latent image by using the developing agent, and a transfer member for transferring the developing agent image to a transfer medium and said developing agent basically contains a coloring material and a binder resin composition, and this binder resin composition contains a mixture of a first wax-containing binder resin having a first wax and a first binder resin and a second wax-containing binder resin having a second wax and a second binder resin.

The image forming apparatus of the present invention is classified into the fourth to seventh aspects described below in accordance with the developing agents used.

According to the fourth aspect of the present invention, an image forming apparatus using the developing agent according to the first aspect is formed.

According to the fifth aspect of the present invention, an image forming apparatus using a developing agent having the characteristics of all of the developing agents according to the first to third aspects is formed.

According to the sixth aspect of the present invention, an image forming apparatus using the developing agent according to the second aspect is formed.

According to the seventh aspect of the present invention, an image forming apparatus using the developing agent according to the third aspect is formed.

As the binder resins used in the present invention, it is possible to use styrene, a polymer of a substitution product of styrene, and an acrylic resin, which are conventionally used as binder resins for toner.

Examples of styrene and a polymer of a substitution product of styrene are a polystyrene homopolymer, a hydrogen-added styrene resin, a styrene-isobutylene copolymer, a styrene-butadiene copolymer, an acrylonitrile-butadiene-styrene terpolymer, an acrylonitrile-styrene-acrylic ester terpolymer, a styrene-acrylonitrile copolymer, an acrylonitrile-acryl rubber-styrene terpolymer, an acrylonitrile-chlorinated polystyrene-styrene terpolymer, an acrylonitrile-EVA-styrene terpolymer, a styrene-p-chlorostyrene copolymer, a styrene-propylene copolymer, styrene-butadiene rubber, a styrene-maleic ester copolymer, a styrene-isobutylene copolymer, and a styrene-maleic anhydride copolymer.

Examples of an acrylic resin are polyacrylate, polymethylmethacrylate, polyethylmethacrylate, poly-n-butylmethacrylate, polyglycidylmethacrylate, a fluorine-containing polyacrylate, a styrene-methacrylate copolymer, a styrene-butylmethacrylate copolymer, and a styrene-ethyl acrylate copolymer.

It is also possible to use polyvinyl chloride, polyvinyl acetate, polyethylene, polypropylene, polyester, polyurethane, polyamide, an epoxy resin, a phenolic resin, a urea resin, polyvinylbutyral, a polyacrylic resin, rosin, modified rosin, a terpene resin, an aliphatic or alicyclic hydrocarbon resin, an aromatic petroleum resin, chlorinated paraffin, and paraffin wax. These materials can be used singly or in the form of a mixture of two or more types thereof.

In particular, the following materials can be used as a polyester resin.

A polyester resin usable as a binder resin in the present invention can be any polyester resin known as a binder resin in toner for dry electrophotography. An example is a polyester resin essentially having a dicarboxylic acid component and a glycol component and having a softening point of 50° to 160° C., preferably at the temperature of 50° to 150° C. a hydroxyl group value of 100 mg KOH/g or less, and an acid value of 100 mg KOH/g or less.

To improve the toner characteristics, this polyester resin can be partially given a three-dimensional crosslinking structure by replacing a portion of the glycol component and/or the dicarboxylic acid component with trivalent or tetravalent alcohol e.g., sorbitol, hexatetrol, dipentaerythrytol, glycerol, or sucrose, and/or trivalent or tetravalent carbon e.g., benzenetricarboxylic acid, cylcohexanetricarboxylic acid, naphthalenetricarboxylic acid, butanetricarboxylic acid, trimellitic acid, or pyromellitic acid. A1ternatively, a partial crosslinking structure or a graft structure can be formed by introducing an epoxy group or an urethane bond.

Examples of the dicarboxylic acid component used in the manufacture of these polyester resins are maleic acid, fumaric acid, masaconic acid, citraconic acid, itaconic acid, glutaconic acid, phthalic acid, isophthalic acid, terephthalic acid, cyclohexanedicarboxylic acid, succinic acid, adipinic acid, sebasic acid, malonic acid, linoleic acid, and acid anhydrides and lower alcohol esters of these acids. Examples of the glycol component are ethyleneglycol, propyleneglycol, butyleneglycol, monopentylglycol, hexanediol, diethyleneglycol, triethyleneglycol, polyethyleneglycol, dimethylolbenzene, cyclohexanedimethanol, bisphenol A, and hydrogenated bisphenol A.

Examples of the coloring material used in the present invention are carbon black and known pigments and dyes. Although these materials are not particularly limited, examples of carbon black are acetylene black, furnace black, thermal black, channel black, and ketchen black. Examples of pigments and dyes are fast yellow G, benzidine yellow, Indofast orange, Irgazin red, carmine FB, permanent Bordeaux FRR, pigment orange R, lithol red 2G, lake red C, rhodamine FB, rhodamine B lake, phtharocyanine blue, pigment blue, brilliant green B, phtharocyanine green, and quinacridone. These pigments and dyes can be used singly or in the form of a mixture.

As a mixing and dispersing means, it is possible to use wet dispersion using a high-speed dissolver, a roll mill, or a ball mill, or melt-kneading using a roll, a pressure kneader, an internal mixer, or a screw extruder. As a mixing means, a ball mill, a V mixer, a ferberg, or a Henschel mixer can be used. As a means for coarsely grinding a mixture, it is possible to use, e.g., a hammer mill, a cutter mill, a jet mil, a roller mill, or a ball mill. A jet mill or a high-speed rotary grinder can be used as a means for finely grinding a coarsely ground product. Also, an air-stream classifier can be used as a means for classifying a finely ground product.

A wax used in the present invention can be added when a binder resin is polymerized or melt-kneaded. When the addition is performed in the polymerization step, the internal addition amount is desirably 1 to 10 parts by weight with respect to 100 parts by weight of the resin, although the amount changes in accordance with the resin in which the wax is to be internally added. If the amount is less than 1 part by weight, no satisfactory effect can be obtained, so a large amount of a wax often needs to be added as an additive. If the amount is larger than 10 parts by weight, dispersion becomes difficult during polymerization, resulting in low dispersibility.

Examples of the waxes used in the present invention are polyethylene and polypropylene.

In the present invention, waxes for improving the offset resistance or an electrification control agent for controlling the triboelectrification charge amount can be further added, where necessary, during polymerization or melt-kneading. It is also possible to add a surface treating agent for improving the fluidity during melt-kneading.

These waxes can be the same or different from the waxes described above and are preferably polyethylene or polypropylene.

Examples of the electrification control agent are negative control agents such as a metal chelate of alkylsalicylic acid, chlorinated polyester, acid-excess polyester, chlorinated polyolefin, a metal salt of aliphatic acid, and aliphatic soap.

Examples of the surface treating agent are hydrophobic silica, metal soap, and a fluoride.

Preferable forms of a wax mixture will be described below.

When SP1 of the first wax>SP3 of the second wax, the first wax having SP1 has lower polarity and is harder to dissolve. In this case, if the first and second resins are used and have solubility parameters SP2 and SP4, respectively, and the following relation holds $|SP_2-SP_1|<|SP_4-SP_3|$ combinations of the first wax+the first resin and the second wax+the second resin are preferable.

This is because closer SP values improve dispersion to realize toner which has good fixing properties and charging properties and prevents the formation of black dots or scattering.

If combinations are the first wax+the second resin and the second wax+the first resin, the waxes do not disperse well to result in smear, backside contamination, and the formation of black dots.

The mixing ratio of the two resins is preferably 20:80 to 80:20 as a weight ratio. If the mixing ratio falls outside this weight ratio, the respective functions of the two resins cannot be well achieved.

If the resins are different, the difference between the solubility parameters of the resins is desirably 0.2 to 4.0.

If the difference is larger than the upper limit, the resins dissolve each other and no longer exhibit their respective characteristic features.

If the difference is smaller than the lower limit, the resins do not well disperse each other and sometimes scatter.

The present invention will be described in detail below by way of its examples with reference to the accompanying drawing.

Examples 1 to 5 relate to the inventions according to the first to fifth aspects of the present invention.

EXAMPLE 1

First, an embodiment of an image forming apparatus of the present invention will be described below.

FIG. 1 shows the embodiment of an image forming apparatus of the present invention.

Referring to FIG. 1, a photosensitive drum 3 as an image carrier is so provided as to be rotatable in a direction a.

The following components are arranged in the direction of rotation around the photosensitive drum 3. In FIG. 1, a charger 5 for uniformly charging the photosensitive drum 3 is disposed to oppose the photosensitive drum 3.

In a portion above the photosensitive drum 3, an original glass plate 7 on which an original is placed, an automatic document feeder (to be referred to as an ADF 8 hereinafter) for feeding an original onto the original glass plate 7, and an exposure section 9 for forming an electrostatic latent image by exposing the charged photosensitive drum 3 in accordance with an original image are arranged. The construction of the ADF 8 will be described in detail later.

The exposure section 9 includes an exposure lamp 11 as a light source, reflecting mirrors 13*a*, 13*b*, 13*c*, 13*d*, 13*e*, and 13*f* and slit glass 13*g* for guiding light originating from the exposure lamp 11 onto the photosensitive drum 3, and a lens unit 14 for forming an image of the reflected light.

A developing unit 15 is arranged downstream of the exposure section 9. This developing unit 15 contains toner T and carrier (not shown) as a developing agent and develops an electrostatic latent image formed with this toner T by the exposure section 9. A transfer charger 17 for transferring the toner image formed by the developing unit 15 onto a sheet as an image formation medium is arranged downstream of the developing unit 15.

The charger 5, the exposure section 9, and the developing unit 15 constitute a developing agent image forming means.

A separation charger 19 for separating the sheet which electrostatically sticks to the photosensitive drum 3 upon transfer is arranged adjacent to the transfer charger 17. A cleaning device 21 for removing any toner T remaining on the photosensitive drum 3 after transfer is arranged downstream of the separation charger 19. This cleaning device 21 has a cleaning blade 23. A charge remover 25 for removing the electric charge from the photosensitive drum 3 is arranged downstream of the cleaning device 21.

Referring to FIG. 1, a paper feed cassette 27 containing sheets P is detachably attached to the main body of an image forming apparatus 1 on the right side of the photosensitive drum 3. A pickup roller 29 for picking up sheets in the paper feed cassette 27 is also attached to the image forming apparatus 1 main body. Additionally, a pair of paper feed rollers 31 for separately feeding the sheets one by one are arranged close to the pickup roller 29.

A pair of aligning rollers 32 for feeding the conveyed sheet at a predetermined timing toward the photosensitive drum 3 is arranged upstream of the transfer charger 17 in the conveyance direction of the sheet. The aligning rollers 32 pinch and convey the sheet and thereby supply the sheet to a portion between the photosensitive drum 3 and the transfer charger 17.

The separation charger 19, a conveyor belt 33 for carrying and conveying the sheet to a fixing unit 35 (to be described later), and the fixing unit 35 as a fixing means for fixing a toner image on the sheet are arranged downstream of the transfer charger 17 in the conveyance direction of the sheet.

The conveyor belt 33 is made from an insulating material. The conveyor belt 33 electrostatically attracts the sheep P, which is charged when given electric charge from the transfer charger 17, and conveys the sheet toward the fixing unit 35 to be described later.

The fixing unit 35 includes a pair of rollers constituted by a heating roller 37 and a press roller 39. The toner image is melt-fixed on the sheet when the heating roller 37 and the press roller 39 rotate in directions indicated by arrows c and d, respectively, in FIG. 1.

A pair of paper delivery rollers 43 for delivering the fixed sheet to the outside of the image forming apparatus and a paper receiving tray 45 for receiving the delivered sheet are arranged downstream of the fixing unit 35 along the conveyance direction of the sheet.

The ADF 8 has an original table 47 on which originals are placed and a pickup roller 49 for picking up originals placed on the original table 47. Originals are placed on the original table 47 with their image-bearing surfaces facing up. A separation belt 51 and a paper feed roller 53 for separately feeding originals one by one toward the original glass plate 7 are arranged to oppose each other in the vicinity of the pickup roller 49. Also, an aligning roller 55 for aligning and feeding an original toward the original glass plate 7 is disposed at halfway from the separation belt 51 and the paper feed roller 53 to the original glass plate 7.

An original conveyor belt 57 for conveying an original on the original glass plate 7 is arranged to oppose the original glass plate 7. A reversal roller 59 for turning over an original and a delivery roller 61 for delivering an original to the outside of the ADF 8 are arranged downstream of the original conveyor belt 57 along the original conveyance direction.

An image formation process in the image forming apparatus with the above construction will be described below.

When image formation start is instructed via an operation panel (not shown) or the like, the photosensitive drum 3 starts rotating in the direction of the arrow a. The charger 5 uniformly charges the surface of the rotating photosensitive drum 3.

The ADF 8 feeds originals one by one onto the original glass plate 7. The exposure lamp 11 moves while irradiating light onto an original placed on the original glass plate 7. Consequently, the exposure section 9 exposes the charged photosensitive drum 3 in accordance with an original image and forms an electrostatic latent image. The developing unit 15 adheres the charged toner T to the electrostatic latent image to form a toner image. The sheets P are picked up one by one from the paper feed cassette 27 by the pickup roller 29 and the paper feed rollers 31 and supplied to a portion between the photosensitive drum 3 and the transfer charger 17 by the aligning rollers 32.

The transfer charger 17 gives electric charge having a polarity opposite to the charge polarity of the toner T to the backside of the supplied sheet and transfers the toner image onto the sheet.

The separation charger 19 performs corona discharge to separate the sheet, sticking to the photosensitive drum 3 upon transfer, from the photosensitive drum 3. The conveyor belt 3 conveys the separated sheet toward the fixing unit 35.

The fixing unit 35 thermally melts the toner image on the heated sheet to fix the toner image to the sheet. The sheet is then delivered onto the paper receiving tray 45 by rotation of the paper delivery rollers 43.

Meanwhile, the photosensitive drum 3 is charge-removed by the charge remover 25 after the toner T remaining after transfer is removed by the cleaning device 21. Upon charge removal by the charge remover 25, the photosensitive drum 3 completes one cycle of the image formation process. When the next image formation is started, the photosensitive drum 3 is again charged by the charger 5. Meanwhile, the original is conveyed by the original conveyor belt 57 and delivered to the outside of the ADF 8.

Practical examples of the developing agent of the present invention preferably used in the image forming apparatus described above will be presented below.

First, wax-containing resins A and B constituting toner were prepared as follows.

<Preparation of wax-containing resin A>

The following were prepared as the materials of the wax-containing resin A.

| Materials of wax-containing resin A | parts by weight |
|---|---|
| Styrene | 85 |
| n-Butyl acrylate | 15 |
| Azobisisobutyronitrile (AIBN) | 0.4 |
| Wax 1 (polypropylene wax NP055 (available from Mitsui Petrochemical Industries, Ltd.), SP value 8.6) | 5 |

These materials were well mixed by using a sand stirrer.

A flask containing 200 parts by weight of isopropanol as a reaction solvent was prepared, and the above materials were charged in the flask under stirring.

Thereafter, the mixture in the flask was heated to 60° C. and polymerized for 8 hr. After the polymerization reaction, the reaction product was cooled, and the resultant substance was dehydrated, washed, and dried to obtain the wax-containing resin A.

Resin 1 was obtained by similarly polymerizing the materials except the wax of the wax-containing resin A. The SP value of resin 1 was measured and found to be 8.8.

Note that the SP value was measured as follows.

Generally, SP value can be determined by calculation or measurement according to well known methods. In the case of calculation, a method by Fedors (Polymer Engineering Science, 14 (2), P. 147, (1947)) can be used. In the case of measurement, a method by Suh (Journal of Polymer Science Part-A-1, 5, P. 1671 (1967)) can be used. In this examples, the latter was used.

<Preparation of wax-containing resin B>

| Materials of wax-containing resin B | parts by weight |
|---|---|
| Styrene | 60 |
| n-Butyl acrylate | 40 |
| Azobisisobutyronitrile (AIBN) | 0.4 |
| Wax 2 (polypropylene wax, SP value 7.6) | 5 |

These materials were polymerized following the same procedure for the wax-containing resin A to obtain the wax-containing resin B.

Resin 2 was obtained by similarly polymerizing the materials except wax 2 of the wax-containing resin B. The SP value of resin 2 was measured and found to be 9.0.

The SP value of wax 1 is larger than the SP value of wax 2, and a difference Δ1 between the SP values of wax 1 and resin 1 is 0.2. A difference Δ2 between the SP values of wax 1 and resin 2 is 0.4. That is, the wax having a larger SP value is contained in resin 1 having a closer SP value.

The wax-containing resins A and B thus prepared were mixed at a ratio of 50:50, 5 parts by weight of carbon were added to the mixture, and the resultant material was melt-kneaded at a temperature of about 170° C.

After the resultant melt-kneaded product was cooled, it was ground and classified to obtain toner particles having a volume average particle size of 9 Tm and a particle size range of 5 to 14 Tm.

0.2 parts by weight of hydrophobic silica (R972 prepared by Japan Aerosil Co.) were mixed in 100 parts by weight of the toner particles to obtain a developing agent.

This developing agent was applied to the image forming apparatus shown in FIG. 1 to perform image formation.

After image formation was performed, high-temperature offset, the condition of smear, backside contamination, toner scattering, and life black dots were evaluated. Consequently, no black dots were found on the photosensitive drum, and neither offset phenomenon nor toner scattering occurred. Also, the obtained images were good and free of backside contamination and smear. The SP values of the individual components of the wax-containing resins are shown in Table 1 to be presented later. The results of image formation are shown in Table 2 to be presented later.

The methods used in the evaluations were as follows.

1) High-temperature offset

After development and transfer, an image was fixed at a linear pressure of 5 kg/cm$^2$ while the roll temperature was changed from 150° C. to 230° C. by using heated roll fixing, and whether more toner transferred to the transfer sheet and contaminated the image was observed.

Reference symbol ○ indicates the nonoccurrence of image contamination; Δ, the occurrence of image contamination at 200° C.; and X, the occurrence of image contamination at temperatures less than 200° C.

2) Condition of smear

An image of a predetermined test chart was formed on 50 letter size sheets available from Hammer Mill Co., and these sheets were supplied to the ADF of the image forming apparatus. Whether image contamination, i.e., smear was caused by the pressure or friction of the separation belt was checked.

Reference symbol ○ indicates no image contamination; Δ, a slight image contamination; and X, the occurrence of image contamination at temperatures less than 200° C.

3) Backside contamination

After 50 leisure size sheets were supplied at ID 0.6 to 0.8, 10 white sheets (leisure size) were supplied. Reference symbol ◎ indicates no contamination on the backside of a sheet; ○, almost no contamination; Δ, a little contamination; and X, a lot of contamination. ◎ was used to indicate very good result. ○ was used to indicated good result.

4) Toner scattering

An A4 solid image original was developed in the image forming apparatus. After 20,000 sheets were developed, a lightness difference reduced by toner scattering and sticking to a toner scattering measurement portion (background color: white) arranged between development sleeves of the developing unit was measured by non-contact color-color difference measurement (color-color difference meter; CS-100, prepared by MINOLTA CAMERA CO., LTD.), thereby obtaining the lightness difference from the background color.

Reference symbol ◎ indicates no lightness difference; ○, almost no lightness difference; Δ, a small lightness difference; and X, a large lightness difference.

5) Life black dots

After an A4 original of ID 0.6 was developed on 200,000 sheets in the image forming apparatus, A3 totally white images were formed. Thereafter, the images were visually checked for black dots.

Examples 2 to 5 and Comparative Examples 1 and 2 will be described below. In these examples, image formation was performed by using an image forming apparatus similar to that used in Example 1. Therefore, a description of the image forming apparatus will be omitted.

EXAMPLE 2

In this example, toner was prepared following the same procedures as in Example 1 except that the mixing ratio of the wax-containing resin A and the wax-containing resin B was changed to 80:20.

EXAMPLE 3

Wax-containing resins C and D constituting toner were prepared as follows.

<Preparation of wax-containing resin C>

The following were prepared as the materials of the wax-containing resin C.

| Materials of wax-containing resin C | parts by weight |
|---|---|
| Polyoxypropylene(2,2)-2,2-bis(4-hydroxyphenyl)propane | 250 |
| Fumaric acid | 50 |
| Trimellitic anhydride | 50 |
| Wax 3 (polyethylene wax, SP value 11.5) | 3 |

Polyoxypropylene(2,2)-2,2-bis(4-hydroxyphenyl) propane, fumaric acid, and trimellitic anhydride were charged in a four-necked glass flask and reacted under stirring at 240° C. by using a stainless steel stirring bar, a thermometer, and a flow condenser in a nitrogen stream.

The reaction was ended in 5 hr, the resultant material was cooled to 60° C., a wax was added, and the material was again stirred for 5 hr.

After the reaction, the resultant material was cooled, washed, and dried to obtain a resin.

Resin 3 prepared without using the wax had an SP value of 11.3.

<Preparation of wax-containing resin D>

The wax-containing resin D was prepared following the same procedures as for the wax-containing resin C except that 5 parts by weight of wax 4 (polypropylene wax, SP value 10.8) were used instead of wax 3 as one material of the wax-containing resin D and the mixing ratio of the materials used in the manufacture of the wax-containing resin C was changed. Note that resin 4 prepared without using wax 4 had an SP value of 11.0.

The SP value of wax 3 is larger than the SP value of wax 4. Also, the difference between the SP values of resin 3 and wax 3 is smaller than the difference between the SP values of resin 4 and wax 3.

The wax-containing resin D thus prepared and the wax-containing resin C were mixed at a mixing ratio of 50:50 to prepare a developing agent following the same procedure as in Example 1.

This developing agent was applied to the image forming apparatus shown in FIG. 1 to perform image formation. The SP values of the individual components of the wax-containing resins are shown in Table 1 to be presented later. Also, the results of image formation are shown in Table 2 to be presented later.

EXAMPLE 4

Toner was prepared following the same procedures as in Example 3 except that the mixing ratio of the wax-containing resins C and D was changed to 70:30.

EXAMPLE 5

A wax-containing resin E was prepared.

<Preparation of wax-containing resin E>

The wax-containing resin E was prepared following the same procedures as for the wax-containing resin A except that 5 parts by weight of wax 2 were used instead of wax 1 as one material of the wax-containing resin E.

The wax-containing resins E and D. were mixed at a ratio of 50:50 to prepare a developing agent following the same procedure as in Example 1.

The SP value of wax 4 is larger than the SP value of wax 2. Also, a difference Δ1 between the SP values of wax 4 and resin 4 is 0.2, and a difference Δ2 between the SP values of wax 4 and resin 1 is 2.0. That is, the wax having a higher SP value is contained in one of the two types of resins having a closer SP value.

This developing agent was applied to the image forming apparatus shown in FIG. 1 to perform image formation. The SP values of the individual components of the wax-containing resins are shown in Table 1 to be presented later. Also, the results of image formation are shown in Table 2 to be presented later.

COMPARATIVE EXAMPLE 1

In this example, the wax-containing resin B and a wax-containing resin F presented below were mixed.

First, the wax-containing resin F was prepared as follows.

<Preparation of wax-containing resin F>

| Materials of wax-containing resin F | parts by weight |
|---|---|
| Styrene | 90 |
| n-Butyl acrylate | 10 |
| Azobisisobutyronitrile | 0.4 |
| Wax 5 (polypropylene wax, SP value 13.0) | 5 |

The wax-containing resin F was prepared by polymerizing these materials following the same procedures as for the wax-containing resin A.

Resin 5 was obtained by similarly polymerizing the materials except wax 5 of the wax-containing resin F. The SP value of resin 5 was measured and found to be 8.4.

The wax-containing resin F thus prepared and the wax-containing resin B were mixed at a ratio of 50:50 to obtain a developing agent following the same procedure as in Example 1.

This developing agent was applied to the image forming apparatus shown in FIG. 1 to perform image formation. The SP values of the individual components of the wax-containing resins are shown in Table 1 to be presented later. Also, the results of image formation are shown in Table 2 to be presented later.

COMPARATIVE EXAMPLE 2

In this example, the wax-containing resin F and a wax-containing resin G presented below were mixed.

First, the wax-containing resin G was prepared as follows.

<Preparation of wax-containing resin G>

The wax-containing resin G was prepared following the same procedures as for the wax-containing resin D except that 5 parts by weight of wax 6 (polyethylene wax, SP value 6.1) were used instead of wax 3.

The wax-containing resin G thus prepared and the wax-containing resin F were mixed at a ratio of 50:50 to obtain a developing agent following the same procedure as in Example 1.

This developing agent was applied to the image forming apparatus shown in FIG. 1 to perform image formation. The SP values of the individual components of the wax-containing resins are shown in Table 1 below. Also, the results of image formation are shown in Table 2 below.

TABLE 1

| | WAX CONTAINING RESIN A (WAX 1 + RESIN 1) | WAX CONTAINING RESIN B (WAX 2 + RESIN 2) | WAX CONTAINING RESIN C (WAX 3 + RESIN 3) | WAX CONTAINING RESIN D (WAX 4 + RESIN 4) | WAX CONTAINING RESIN E (WAX 2 + RESIN 1) | WAX CONTAINING RESIN F (WAX 5 + RESIN 5) | WAX CONTAINING RESIN G (WAX 6 + RESIN 3) |
|---|---|---|---|---|---|---|---|
| RESIN SP VALUE | 8.8 | 9.0 | 11.3 | 11.0 | 8.8 | 8.4 | 11.3 |
| WAX SP VALUE | 8.6 | 7.6 | 11.5 | 10.8 | 7.6 | 13.0 | 6.1 |
| DIFFERENCE BETWEEN SP VALUES | 0.2 | 1.4 | 0.2 | 0.2 | 1.2 | 4.6 | 5.4 |

TABLE 2

| | COMPOSITION OF RESIN | HIGH TEMPERATURE OFFSET | CONDITION OF SMEAR | BACKSIDE CONTAMINATION | TONER SCATTERING | LIFE BLACK DOTS |
|---|---|---|---|---|---|---|
| EXAMPLE 1 | A:B = 50:50 | ○ | ○ | ◎ | ○ | NONE |
| EXAMPLE 2 | A:B = 80:20 | ○ | ○ | ◎ | ○ | NONE |

TABLE 2-continued

| | COMPOSITION OF RESIN | HIGH TEMPERATURE OFFSET | CONDITION OF SMEAR | BACKSIDE CONTAMINATION | TONER SCATTERING | LIFE BLACK DOTS |
|---|---|---|---|---|---|---|
| EXAMPLE 3 | D:E = 50:50 | ○ | ○ | ◎ | ○ | NONE |
| EXAMPLE 4 | D:E = 70:30 | ○ | ○ | ○ | ○ | NONE |
| EXAMPLE 5 | C:E = 50:50 | ○ | ○ | ○ | ○ | NONE |
| COMPARATIVE EXAMPLE 1 | B:F = 50:50 | Δ | x | ○ | Δ | EXISTING |
| COMPARATIVE EXAMPLE 2 | F:G = 50:50 | Δ | x | Δ | Δ | EXISTING |

As is apparent from Table 1, when the first wax-containing resin was prepared by combining one of the two types of waxes having a higher SP value with the resin having a closer SP value, good results were obtained; a high offset resistance was obtained, and smear, backside contamination, toner scattering, and life black dots were prevented. However, no such good results were obtained when the first wax-containing resin was prepared by combining one of the two types of waxes having a higher SP value with the resin having a separate SP value.

EXAMPLE 6

This example relates to the invention according to the second aspect of the present invention.

The wax-containing resin E used in Example 5 was prepared.

The SP value of the wax was 7.6, and the SP value of resin 1 not containing the wax was 8.8. A molecular weight Mw of this resin 1 was measured and found to be 180,000.

Additionally, a wax-containing resin H was prepared as follows in this example.

<Preparation of wax-containing resin H>

Wax 7 having an SP value of 9.0 was prepared, and the wax-containing resin H was prepared by polymerization following the same procedures as for the wax-containing resin E except that the composition ratio and the reaction time were adjusted. When polymerization was performed without using the wax, the SP value and the molecular weight Mw of the resultant resin were 8.8 and 220,000, respectively.

50 parts by weight of the wax-containing resin E and 50 parts by weight of the wax-containing resin H were mixed to manufacture a developing agent following the same procedure as in Example 1.

The resultant developing agent was applied to the image forming apparatus shown in FIG. 1 to perform image formation. Table 3 shows the SP values and molecular weights of the individual wax-containing resins used. Also, Table 4 shows the results of image formation.

COMPARATIVE EXAMPLE 3

A wax-containing resin I and a wax-containing resin J constituting a toner were prepared as follows.

<Preparation of wax-containing resin I>

The wax-containing resin I was prepared following the same procedures as for the wax-containing resin E except that the wax contained in the wax-containing resin E was changed to wax 7 having an SP value of 9.0. The SP value of a resin not containing the wax was 8.8. The molecular weight Mw of this resin was measured and found to be 180,000.

<Preparation of wax-containing resin J>

The wax-containing resin J was prepared following the same procedures as for the wax-containing resin H except that the wax contained in the wax-containing resin H was changed to wax 2 having an SP value of 7.6. The SP value of a resin not containing the wax was 8.8. The molecular weight Mw of this resin was measured and found to be 220,000.

50 parts by weight of the wax-containing resin I and 50 parts by weight of the wax-containing resin J were mixed to manufacture a developing agent following the same procedure as in Example 1.

The resultant developing agent was applied to the image forming apparatus shown in FIG. 1 to perform image formation. Table 3 shows the SP values and molecular weights of the individual wax-containing resins used. Table 4 shows the results of image formation. As shown in Table 4, smear was found.

TABLE 3

| | WAX CONTAINING RESIN E | WAX CONTAINING RESIN H | WAX CONTAINING RESIN I | WAX CONTAINING RESIN J |
|---|---|---|---|---|
| RESIN SP VALUE | 8.8 | 8.8 | 8.8 | 8.8 |
| WAX SP VALUE | 7.6 | 9.0 | 9.0 | 7.6 |
| MOLECULAR WEIGHT OF RESIN | 180000 | 220000 | 180000 | 220000 |

TABLE 4

| | COMPOSITION OF RESIN | HIGH TEMPERATURE OFFSET | CONDITION OF SMEAR | BACKSIDE CONTAMENATION | TONER SCATTERING | LIFE BLACK DOTS |
|---|---|---|---|---|---|---|
| EXAMPLE 6 | E:H = 50:50 | ○ | ○ | ◎ | ○ | NONE |
| COMPARATIVE EXAMPLE 3 | I:J = 50:50 | ○ | Δ | ◎ | ○ | NONE |

Example 6 and Comparative Example 3 demonstrate that a good developing agent can be obtained by preferentially combining a wax having a high SP value with a high-molecular weight resin.

EXAMPLE 7

This example relates to the invention according to the third aspect of the present invention.

A wax-containing resin K and a wax-containing resin L constituting toner were prepared as follows.

<Preparation of wax-containing resin K>

The wax-containing resin K was prepared following the same procedures as for the wax-containing resin C except that polyethylene wax (SP value 11.4) was used as wax 8, the materials (except the wax) used in the manufacture of the wax-containing resin C were used, and the reaction time and temperature were adjusted. When polymerization was performed without using the wax, the SP value and a glass transition point Tg of the resultant resin were 11.3 and 60° C., respectively.

<Preparation of wax-containing resin L>

Subsequently, the wax-containing resin L was prepared following the same procedures as for the wax-containing resin C except that wax 9 having an SP value of 10.8 was used, the materials (except the wax) used in the manufacture of the wax-containing resin C were used, and the reaction time and temperature were adjusted. When polymerization was performed without using the wax, the SP value and the glass transition point Tg of the resultant resin were 11.3 and 57° C., respectively.

50 parts by weight of the wax-containing resin K and 50 parts by weight of the wax-containing resin L were mixed to manufacture a developing agent following the same procedure as in Example 1.

The resultant developing agent was applied to the image forming apparatus shown in FIG. 1 to perform image formation. Table 5 shows the SP values and glass transition points of the individual wax-containing resins used. Also, Table 6 shows the results of image formation.

COMPARATIVE EXAMPLE 4

A wax-containing resin M and a wax-containing resin N constituting a toner were prepared as follows.

<Preparation of wax-containing resin M>

The wax-containing resin M was prepared following the same procedures as for the wax-containing resin K except that polypropylene wax (SP value 10.8) was used. When polymerization was performed without using the wax, the SP value and the glass transition point Tg of the resultant resin were 11.3 and 60° C., respectively.

<Preparation of wax-containing resin N>

The wax-containing resin N was prepared following the same procedures as for the wax-containing resin D except that wax 8 having an SP value of 11.4 was used. When polymerization was performed without using the wax, the SP value and the glass transition point Tg of the resultant resin were 11.3 and 57° C., respectively.

50 parts by weight of the wax-containing resin M and 50 parts by weight of the wax-containing resin N were mixed to manufacture a developing agent following the same procedure as in Example 1.

The resultant developing agent was applied to the mage forming apparatus shown in FIG. 1 to perform image formation. Table 5 shows the SP values and molecular weights of the individual wax-containing resins used. Table 6 shows the results of image formation.

TABLE 5

| | WAX CONTAINING RESIN K | WAX CONTAINING RESIN L | WAX CONTAINING RESIN M | WAX CONTAINING RESIN N |
|---|---|---|---|---|
| RESIN SP VALUE | 11.3 | 11.3 | 11.3 | 11.3 |
| WAX SP VALUE | 11.4 | 10.8 | 10.8 | 11.4 |
| GLASS TRANSITION POINT OR RESIN | 60 | 57 | 60 | 57 |

TABLE 6

| | COMPOSITION OF RESIN | HIGH TEMPERATURE OFFSET | CONDITION OF SMEAR | BACKSIDE CONTAMINATION | TONER SCATTERING | LIFE BLACK DOTS |
|---|---|---|---|---|---|---|
| EXAMPLE 7 | K:L = 50:50 | ○ | ○ | ◎ | ○ | NONE |
| COMPARATIVE EXAMPLE 4 | M:N = 50:50 | ○ | Δ | ◎ | ○ | NONE |

Example 7 and Comparative Example 4 reveal that a good developing agent can be obtained by preferentially combining a wax having a high SP value with a resin having a high glass transition point.

EXAMPLE 8

In this example, a wax-containing resin O and a wax-containing resin P constituting toner were prepared as follows.

This example relates to the inventions according to the fourth and eighth aspects of the present invention.

| Materials of wax-containing resin O | parts by weight |
|---|---|
| Styrene | 70 |
| n-Propane acrylate | 30 |
| Azobisisobutyronitrile | 0.4 |
| Polyethylene wax (SP value 7.6) | 5 |

The wax-containing resin O was prepared by adjusting the reaction time and temperature. When polymerization was performed without using the wax, the SP value, the molecular weight, and the glass transition point Tg of the resultant resin were 8.7, 180,000, and 57° C. respectively.

| Materials of wax-containing resin P | parts by weight |
|---|---|
| Styrene | 90 |
| n-Pentane acrylate | 10 |
| Azobisisobutyronitrile | 0.4 |
| Polyethylene wax (SP value 9.0) | 5 |

The wax-containing resin P was prepared by adjusting the reaction time and temperature. When polymerization was performed without using the wax, the SP value, the molecular weight, and the glass transition point Tg of the resultant resin were 9.1, 220,000, and 60° C., respectively.

50 parts by weight of the wax-containing resin O and 50 parts by weight of the wax-containing resin P were mixed to manufacture a developing agent following the same procedure as in Example 1.

The resultant developing agent was applied to the image forming apparatus shown in FIG. 1 to perform image formation. Table 7 shows the SP values and molecular weights of the individual wax-containing resins used. Also, Table 8 shows the results of image formation.

TABLE 7

| | WAX CONTAINING RESIN O | WAX CONTAINING RESIN P |
|---|---|---|
| RESIN SP VALUE | 8.7 | 9.1 |
| WAX SP VALUE | 7.6 | 9.0 |
| MOLECULAR WEIGHT OF RESIN | 180000 | 220000 |
| GLASS TRANSITION POINT OF RESIN | 57 | 57 |

Example 8 and Comparative Example 5 show that a good developing agent can be obtained by preferentially combining a wax having a high SP value with a resin having a high molecular weight and a high glass transition point.

Note that in Examples 6, 7, and 8, it is desirable to select combinations of resins and waxes so that a resin having a high glass transition point and/or a high molecular weight is combined with a wax having an SP value close to the SP value of the resin.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A developing agent containing a first wax-containing binder resin having a first wax and a first binder resin, a second wax-containing binder resin having a second wax and a second binder resin, and a coloring material, wherein said first wax has a first solubility parameter value SP1, said first binder resin has a second solubility parameter value SP2 having a difference Δ1 from the first solubility parameter value SP1, said second wax has a third solubility parameter value SP3 smaller than the first solubility parameter value SP1, and said second binder resin has a solubility parameter value SP4 having a difference Δ2 larger than Δ1 from the first solubility parameter value SP1.

2. A developing agent according to claim 1, wherein said first binder resin has a first molecular weight M1, and said second binder resin has a second molecular weight M2 smaller than the first molecular weight M1.

3. A developing agent according to claim 1, wherein said first binder resin has a first glass transition point Tg1, and said second binder resin has a second glass transition point Tg2 smaller than the first glass transition point Tg1.

4. A developing agent according to claim 1, wherein said first binder resin has a first molecular weight M1 and a first glass transition point Tg1, and said second binder resin has a second molecular weight M2 smaller than the first molecular weight M1 and a second glass transition point Tg2 smaller than the first glass transition point Tg1.

5. A developing agent according to claim 1, wherein said first wax is added when said first binder resin is polymerized, and said second wax is added when said second binder resin is polymerized.

6. A developing agent according to claim 1, wherein said first wax is added when said first binder resin is polymerized, and said second wax is added when said second binder resin is melt-kneaded.

7. A developing agent according to claim 1, wherein said first wax is added when said first binder resin is melt-

TABLE 8

| | COMPOSITION OF RESIN | HIGH TEMPERATURE OFFSET | CONDITION OF SMEAR | BACKSIDE CONTAMINATION | TONER SCATTERING | LIFE BLACK DOTS |
|---|---|---|---|---|---|---|
| EXAMPLE 8 | O:P = 50:50 | ○ | ○ | ◎ | ○ | NONE |

kneaded, and said second wax is added when said second binder resin is polymerized.

8. A developing agent containing a first wax-containing binder resin having a first wax and a first binder resin, a second wax-containing binder resin having a second wax and a second binder resin, and a coloring material, wherein said first wax has a first solubility parameter value SP1, said first binder resin has a first molecular weight M1, said second wax has a third solubility parameter value SP3 smaller than the first solubility parameter value SP1, and said second binder resin has a second molecular weight M2 smaller than the first molecular weight M1.

9. A developing agent containing a first wax-containing binder resin having a first wax and a first binder resin, a second wax-containing binder resin having a second wax and a second binder resin, and a coloring material, wherein said first wax has a first solubility parameter value SP1, said first binder resin has a first glass transition point Tg1, said second wax has a third solubility parameter value SP3 smaller than the first solubility parameter value SP1, and said second binder resin has a second glass transition point Tg2 smaller than the first glass transition point Tg1.

10. An image forming apparatus comprising an image carrier, an electrostatic latent image forming member for forming an electrostatic latent image on said image carrier in accordance with image information, a developing unit which contains a developing agent and forms a developing agent image by developing the electrostatic latent image by using the developing agent, and a transfer member for transferring the developing agent image to a transfer medium, wherein said developing agent contains a first wax-containing binder resin having a first wax and a first binder resin, a second wax-containing binder resin having a second wax and a second binder resin, and a coloring material, said first wax has a first solubility parameter value SP1, said first binder resin has a second solubility parameter value SP2 having a difference Δ1 from the first solubility parameter value SP1, said second wax has a third solubility parameter value SP3 smaller than the first solubility parameter value SP1, and said second binder resin has a solubility parameter value SP4 having a difference Δ2 larger than Δ1 from the first solubility parameter value SP1.

11. An apparatus according to claim 10, wherein said first binder resin has a first molecular weight M1, and said second binder resin has a second molecular weight M2 smaller than the first molecular weight M1.

12. An apparatus according to claim 10, wherein said first binder resin has a first glass transition point Tg1, and said second binder resin has a second glass transition point Tg2 smaller than the first glass transition point Tg1.

13. An apparatus according to claim 10, wherein said first wax is added when said first binder resin is polymerized, and said second wax is added when said second binder resin is polymerized.

14. An apparatus according to claim 10, wherein said first wax is added when said first binder resin is polymerized, and said second wax is added when said second binder resin is melt-kneaded.

15. An apparatus according to claim 10, wherein said first wax is added when said first binder resin is melt-kneaded, and said second wax is added when said second binder resin is polymerized.

16. An image forming apparatus comprising an image carrier, an electrostatic latent image forming member for forming an electrostatic latent image on said image carrier in accordance with image information, a developing unit which contains a developing agent and forms a developing agent image by developing the electrostatic latent image by using the developing agent, and a transfer member for transferring the developing agent image to a transfer medium, wherein said developing agent contains a first wax-containing binder resin having a first wax and a first binder resin, a second wax-containing binder resin having a second wax and a second binder resin, and a coloring material, said first wax has a first solubility parameter value SP1, said first binder resin has a second solubility parameter value SP2 having a difference Δ1 from the first solubility parameter value SP1, a first molecular weight M1, and a first glass transition point Tg1, said second wax has a third solubility parameter value SP3 smaller than the first solubility parameter value SP1, and said second binder resin has a fourth solubility parameter value SP4 having a difference Δ2 larger than Δ1 from the first solubility parameter value SP1, a second molecular weight M2 smaller than the first molecular weight M1, and a second glass transition point Tg2 smaller than the first glass transition point Tg1.

17. An image forming apparatus comprising an image carrier, an electrostatic latent image forming member for forming an electrostatic latent image on said image carrier in accordance with image information, a developing unit which contains a developing agent and forms a developing agent image by developing the electrostatic latent image by using the developing agent, and a transfer member for transferring the developing agent image to a transfer medium, wherein said developing agent contains a first wax-containing binder resin having a first wax and a first binder resin, a second wax-containing binder resin having a second wax and a second binder resin, and a coloring material, said first wax has a first solubility parameter value SP1, said first binder resin has a first molecular weight M1, said second wax has a third solubility parameter value SP3 smaller than the first solubility parameter value SP1, and said second binder resin has a second molecular weight M2 smaller than the first molecular weight M1.

18. An apparatus according to claim 17, wherein said first wax is added when said first binder resin is polymerized, and said second wax is added when said second binder resin is polymerized.

19. An apparatus according to claim 17, wherein said first wax is added when said first binder resin is polymerized, and said second wax is added when said second binder resin is melt-kneaded.

20. An apparatus according to claim 17, wherein said first wax is added when said first binder resin is melt-kneaded, and said second wax is added when said second binder resin is polymerized.

21. An image forming apparatus comprising an image carrier, an electrostatic latent image forming member for forming an electrostatic latent image on said image carrier in accordance with image information, a developing unit which contains a developing agent and forms a developing agent image by developing the electrostatic latent image by using the developing agent, and a transfer member for transferring the developing agent image to a transfer medium, wherein said developing agent contains a first wax-containing binder resin having a first wax and a first binder resin, a second wax-containing binder resin having a second wax and a second binder resin, and a coloring material, said first wax has a first solubility parameter value SP1, said first binder resin has a first glass transition point Tg1, said second wax has a third solubility parameter value SP3 smaller than the first solubility parameter value SP1, and said second binder resin has a second glass transition point Tg2 smaller than the first glass transition point Tg1.

22. An apparatus according to claim 21, wherein said first wax is added when said first binder resin is polymerized, and said second wax is added when said second binder resin is polymerized.

23. An apparatus according to claim 21, wherein said first wax is added when said first binder resin is polymerized, and said second wax is added when said second binder resin is melt-kneaded.

24. An apparatus according to claim 21, wherein said first wax is added when said first binder resin is melt-kneaded, and said second wax is added when said second binder resin is polymerized.

* * * * *